US005948182A

United States Patent [19]

Hamano et al.

[11] Patent Number: 5,948,182

[45] **Date of Patent: *Sep. 7, 1999**

[54] HEAT RESISTING STEEL

[75] Inventors: Shuji Hamano; Tomotaka Nagashima, both of Tokai; Michio Okabe, Chita; Toshiharu Noda, Tajimi, all of Japan

[73] Assignee: Daido Tokushuko Kabushiki Kaisha, Aichi-Prefecture, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/727,811

[22] Filed: Oct. 8, 1996

Related U.S. Application Data

[63] Continuation of application No. 08/389,657, Feb. 16, 1995, abandoned.

[30] Foreign Application Priority Data

Feb. 24, 1994 [JP] Japan ..... 6-064306

[51] Int. Cl.[6] ..... C22C 38/50

[52] U.S. Cl. ..... 148/327; 420/40; 420/43; 420/54; 420/580; 148/442

[58] Field of Search ..... 420/8, 43, 40, 420/54, 580; 148/327, 442

[56] References Cited

FOREIGN PATENT DOCUMENTS

| | | |
|---|---|---|
| 56-81661 | 7/1981 | Japan . |
| 58-34129 | 2/1983 | Japan . |
| 61-69950 | 4/1986 | Japan . |
| 61-99659 | 5/1986 | Japan . |
| 61-217555 | 9/1986 | Japan . |
| 63-213643 | 9/1988 | Japan . |

*Primary Examiner*—Sikyin Ip

*Attorney, Agent, or Firm*—Sughrue, Mion, Zinn, Macpeak & Seas, PLLC

[57] ABSTRACT

A heat resisting steel consists essentially of 0.005–0.20% of C, 0.01–2.0% of Si, 0.1–2.0% of Mn, 20–30% of Ni, 10–20% of Cr, 3.0–4.5% of Ti and 0.1–0.7% of Al with the ratio Ti/Al being 5–20, and the balance being substantially Fe, which is excellent in the tensile properties at the room temperature and 700° C., and the creep rupture properties at the temperature of 700° C.

8 Claims, No Drawings

HEAT RESISTING STEEL

This is a continuation of application Ser. No. 08/389,657 filed Feb. 16, 1995 abandoned.

BACKGROUND OF THE INVENTION

1. Field of the Invention

This invention relates to a heat resisting steel used for a material of components requiring heat resistance, corrosion resistance and so on, such as components in, for example, an engine, a turbine, a heat exchanger, a heating furnace, a nuclear equipment and the like.

2. Description of the Prior Art

Heretofore, austenitic heat resisting steel defined as SUH660 by JIS G4311 or G4312 has been used as the material for the aforementioned components requiring heat resistance, corrosion resistance and so on. However, the upper limit of application temperature of the SUH660 steel is 700° C., and super alloys such as Ni-based heat resisting alloy have been used in a thermal condition higher than 700° C.

In recent years, in order to improve generating power of an automotive engine and thermal efficiency of a steam turbine, for example, the exhaust gas temperature and the steam temperature are inclined to rise. Consequently, in the conventional components applied with the steel SUH660 for the engine, the turbine, the heat exchanger, the heating furnace, the nuclear equipment and the like, there are cases where the steel SUH660 is insufficient in the heat resistance and the corrosion resistance. For this reason, the super alloys such as the Ni-based heat resisting alloy have been used in certain circumstances, however a sharp increase in cost is caused in this case.

Therefore, a material is demanded, which is possible to hold down the cost so as not to increase as compared with the steel SUH660, is excellent in the heat resistance and possible to be used even in an atmosphere higher than 700° C.

SUMMARY OF THE INVENTION

This invention is made in order to solve the aforementioned problem of the prior art, and it is an object to provide a heat resisting steel which is excellent in the heat resistance as compared with the steel SUH660, is possible to be used in the atmosphere higher than 700° C. and possible to minimize the cost increase.

That is, the heat resisting steel according to this invention for attaining the aforementioned object is characterized by consisting essentially by weight percentage of 0.005 to 0.20% of C, 0.01 to 2.0% of Si, 0.1 to 2.0% of Mn, 20 to 30% of Ni, 10 to 20% of Cr, 3.0 to 4.5% of Ti and 0.1 to 0.7% of Al with the ratio Ti/Al being 5 to 20, and the balance being substantially Fe.

The heat resisting steel according to this invention may be contained with at least one of B, Nb, Zr, V, Mo, W, Cu, Mg, Ca, and REM (rare earth metal) in order to further improve the high-temperature strength in the respective ranges of 0.001 to 0.50% of B, 0.1 to 3.0% of Nb, 0.001 to 0.50% of Zr, 0.01 to 1.0% of V, 0.1 to 3.0% of Mo, 0.1 to 3.0% of W, 0.1 to 3.0% of Cu, 0.001 to 0.005% of Mg, 0.001 to 0.05% of Ca and 0.001 to 0.05% of REM.

DESCRIPTION OF THE PREFERRED EMBODIMENT

The reason why the chemical composition of the heat resisting steel according to this invention is limited to the aforementioned ranges will be described below.

C: 0.005 to 0.20%

C is effective element for increasing the high-temperature strength of matrix by forming carbides together with Cr and Ti, therefore it is necessary to be added in an amount of not less than 0.005%. However, it is necessary to define the upper limit at 0.20% since the carbides are formed too much and not only the corrosion resistance but also the toughness and ductility are deteriorated when C is added excessively.

Si: 0.01 to 2.0%

Si is an element that mainly acts as a deoxidizer at the time of smelting and it is necessary to be contained in amount of not less than 0.01%. However, Si is defined to not more than 2.0% since the toughness and corrosion resistance against Pb0 (in a case of engine parts) are deteriorated when Si is contained excessively.

Mn: 0.1 to 2.0%

Mn is an element that mainly acts as a deoxidizer at the time of smelting similarly to Si and it is necessary to be contained in an amount of not less than 0.1%. However, the oxidation resistance at high temperatures is degraded when Mn is added too much, and Mn is defined to not more than 2.0%.

Ni: 20 to 30%

Ni is an element that contributes to stabilization of austenite and is effetive to form γ'-phase $\{Ni_3(Al,Ti)\}$ for improve the high-temperature strength and the corrosion resistance, and is necessary to be contained in an amount of not less than 20% in order to obtain such the effect. However, Ni is defined to not more than 30% since the price of the steel becomes higher if Ni is contained excessively.

Cr: 10 to 20%

Cr is an element necessary to secure the corrosion resistance such as the oxidation resistance and so on required as a heat resisting steel. However, when Cr is contained in a large quantity in a steel contained with Ni of in the range of 20 to 30%, the toughness and ductility are deteriorated by forming σ phase and the high-temperature strength is lowered, therefore it is necessary to define Cr to not more than 20%.

Ti: 3.0 to 4.5%

Ti is an available element for forming the γ'-phase effective to improve the high-temperature strength by combining with Ni and Al and it is necessary to be contained in an amount of not less than 3.0% in order to form the γ'-phase as much as possible to obtain the high-temperature strength and creep properties that is excellent as compared with the steel SUH660 and enable the steel to be used in the high-temperature environment higher than 700° C. However, it is necessary to define Ti not more than 4.5% because η-phase ($Ni_3Ti$) is formed so that the high-temperature strength is lowered when the Ti is contained excessively.

Al: 0.1 to 0.7 %

Al is an effective element for forming the γ'-phase and increaseing the high-temperature strength similarly to Ti, so that it is necessary to be contained in an amount of not less than 0.1%. However, it is necessary to be limited to not more than 0.7% since Al has a high affinity for oxygen and not only the productivity but also the hot workability are deteriorated when Al is contained excessively.

Ti/Al: 5~20

In the heat resisting steel according to this invention, the η-phase is apt to be formed because the Ti content is prescribed in the range of 3.0 to 4.5% in order to increase the quantity of the precipitated γ'-phase for the purpose of the improvement for the high-temperature strength. The amount of the γ'-phase is decreased so that the high-temperature strength, the toughness and the ductility are lowered owing to the formation of the η-phase, therefore it is necessary to inhibit the formation of the η-phase during the aging treatment or application.

Since the η-phase becomes easy to be formed as the temperature rises, the formation of the η-phase must be inhibited at the temperature higher than 700° C. in order to enable the steel to be used in the environment higher than 700° C. Furthermore, it is necessary to perform the aging treatment for precipitaion strengthening at the temperature higher than application temperature, and it is necessary to control the η-phase so as not to be formed even if the aging treatment is performed at the temperature higher than 700° C., preferably higher than 750° C. Therefore, in this invention, the chemical compositions, especially the Ti content and the Al content were fully investigated in order to inhibit the formation of the η-phase even when Ti is contained in a large quantity, consequently it was found that the directing properties is obtained by defining a ratio of Ti/Al.

The reason why the Ti/Al ratio is defined will be described below.

When the Ti/Al ratio is too low, the precipitaion of the γ'-phase slows down during the aging treatment and the aging treatment is required for a long time in order to obtain the sufficient strength, thererby causing the increase in cost. Accordingly, the Ti/Al ratio is required of not less than 5. On the oter side, when the Ti/Al ratio becomes higher, though the precipitaion rate of the γ'-phase during the aging treatment is accelerated, the formation of the η-phase becomes easy in shorter time, at lower temperature. Therefore, it is necessary to define the Ti/Al ratio to not more than 20, in order to prevent the formation of the η-phase during the aging treatment at the temperature higher than 700° C. or 750° C. preferably, prevent the formation of the η-phase in spite of exposure in the atmosphere at the temperature higher than 700° C. for a long time and extend the creep rupture lifetime.

B: 0.001 to 0.050%

B is an element that contributes to improving the hot workability, prevents the deterioration of the high-temperature strength and the toughness by inhibiting the formation of the η-phase, and is effective for increasing the creep strength at the elevated temperature. Accordingly, it is necessary to be contained in an amount of not less than 0.001%. However, since the hot workability is obstructed by lowering the melting point of the matrix when B is contained in a large quantity, B has to be defined to not more than 0.050%.

Nb: 0.1 to 3.0%

Because Nb improves the strength by forming the γ'-phase $\{Ni_3(Al,Ti,Nb)\}$, it is desirable to be contained in an amount of not less than 1.0% according to demand. However, it is necessary to be limited to not more than 3.0% since the strength is lowered by forming Laves phase ($Fe_2Nb$) when Nb is contained excessively. Additionally, Nb may be partially replaced with Ta.

Zr: 0.001 to 0.50%

Zr is an effective element for increasing the creep strength similarly to B by precipitating at grain boundary, and it is preferable to be contained in an amount of not less than 0.005% as required for this purpose. However, it is necessary to be defined to not more than 0.5% since the toughness is deteriorated by Zr contained excessively.

V: 0.01 to 1.0%

V is an element effective for reinforcing the grain boundary by forming carbides and increasing the creep strength. For this purpose, it is preferable to be contained in an amount of not less than 0.01% according to demand, however V has to be defined to not more than 1.0% since the toughness is deteriorated by V excessively contained.

Mo: 0.1 to 3.0%

W: 0.1 to 3.0%

Cu: 0.1 to 3.0%

Mo, W and Cu are effective elements for increasing the strength by dissolving in austenite, therefore it is desirable to be contained respectively in an amount of not less than 0.1% as required. However, the hot workability is obstructed and the embrittle plase becomes easy to be precipitated when the content of these elements is excessive, therefore it is necessary to be limited to not more than 3.0%, respectively.

Mg: 0.001 to 0.05%

Ca: 0.001 to 0.05%

REM: 0.001 to 0.05%

Mg, Ca and REM (rare earth metal) are elements having deoxidizing and desulfurizing effects and effective for improving cleanliness of the steel in all cases, and Mg and Ca are elements effective for reinforcing the grain boundary by precipitating at the grain boundary. In order to obtain the above-mentioned effects, it is preferable to be contained in an amount of not less than 0.001% respectively according to demand. However, the hot workability is obstructed, and the toughness and the ductility are degraded when the content of these elements is excessive, accordingly it is necessary to be defined to not more than 0.05%, respectively.

EXAMPLE

Next,the invention will be described in detail with reference to the following examples and comparative examples in order to make clear the characteristics of this invention.

Each of steels having chemical compositions shown in Table 1 was melted in a high-frequency induction furnace of 50 kg-class and cast into an ingot of 50 kg, which was made into a round bar with a diameter of 20 mm through cogging subsequently. Furthermore, the respective round bars were subjected to heat treatment of quenching in water after being heated at 1000° C. for 1 hour, and aging treatment of cooling in air after being heated at 750° C. for 4 hours. After this, specimens were cut out from the respective round bars and a tensile test and a creep rupture test are performed using the specimens. Additionally, comparative steel No.1 shown in Table 1 corresponds to the steel SUH660 defined by JIS.

In this time, the tensile test was carried out by using the specimen defined as No.4 test piece with a diameter of 14 mm by JIS Z2201, whereby 0.2% proof stress, tensile strength and braking elongation are measured at room temperature and 700° C. Further, the creep rupture test was carried out by using the specimen provided with a parallel portion having a diameter of 6 mm, whereby the time required for the specimen to be fractured was measured when stress of 392 MPa and 490 MPa was applied on the specimen at the temperature of 700° C. The measured results are shown in Table 2.

TABLE 1

| Steel No. | C | Si | Mn | Ni | Cr | Ti | Al | Ti/Al | B | Nb | Zr | V | Mo | W | Cu | Mg | Ca | REM |
|---|---|---|---|---|---|---|---|---|---|---|---|---|---|---|---|---|---|---|
| Inventive steel 1 | 0.061 | 0.96 | 0.57 | 25.9 | 14.2 | 3.52 | 0.33 | 11 | | | | | | | | | | |
| Inventive steel 2 | 0.044 | 0.23 | 0.53 | 27.3 | 12.1 | 3.26 | 0.68 | 5 | | | | | | | | | | |
| Inventive steel 3 | 0.149 | 1.25 | 1.32 | 28.4 | 17.2 | 4.33 | 0.26 | 17 | | | | | | | | | | |
| Inventive steel 4 | 0.082 | 0.49 | 0.24 | 21.6 | 19.6 | 4.48 | 0.23 | 19 | | | | | | | | | | |
| Inventive steel 5 | 0.057 | 1.68 | 0.43 | 29.4 | 14.8 | 4.48 | 0.58 | 8 | 0.046 | | | | | | | | | |
| Inventive steel 6 | 0.144 | 1.24 | 0.69 | 20.5 | 11.5 | 3.86 | 0.21 | 18 | 0.0008 | 0.53 | | | | | | | | |
| Inventive steel 7 | 0.113 | 1.11 | 1.44 | 23.5 | 15.3 | 4.22 | 0.64 | 7 | | 0.31 | 0.13 | | | | | | | |
| Inventive steel 8 | 0.183 | 0.21 | 0.97 | 28.4 | 12.1 | 3.97 | 0.24 | 17 | 0.014 | | | 0.21 | | | | | | |
| Inventive steel 9 | 0.017 | 1.28 | 1.11 | 21.4 | 18.5 | 3.11 | 0.53 | 6 | | 12.3 | | 0.05 | 2.10 | | 1.50 | | | |
| Inventive steel 10 | 0.007 | 0.43 | 0.41 | 28.4 | 15.3 | 4.27 | 0.37 | 12 | 0.031 | | 0.37 | | | 2.10 | | | | |
| Inventive steel 11 | 0.147 | 1.24 | 0.24 | 21.5 | 16.3 | 3.77 | 0.41 | 9 | | | | | 1.06 | 1.26 | | | | |
| Inventive steel 12 | 0.013 | 0.37 | 0.75 | 25.4 | 11.8 | 4.41 | 0.52 | 8 | 0.031 | | 0.43 | | | | | 0.013 | 0.014 | |
| Inventive steel 13 | 0.148 | 1.04 | 1.47 | 21.7 | 19.5 | 3.91 | 0.21 | 19 | | 1.37 | | | 1.29 | | | | | 0.032 |
| Inventive steel 14 | 0.031 | 0.31 | 0.59 | 29.5 | 12.5 | 4.42 | 0.64 | 7 | | | | | | | | 0.006 | | 0.012 |
| Inventive steel 15 | 0.031 | 1.72 | 0.31 | 21.6 | 18.4 | 4.04 | 0.21 | 19 | | | | | | 1.41 | | | 0.007 | |
| Comparative steel 1 | 0.041 | 0.51 | 0.61 | 25.5 | 15.2 | 2.14 | 0.11 | 19 | 0.007 | | | | | | | | | |
| Comparative steel 2 | 0.021 | 0.31 | 1.21 | 27.4 | 16.3 | 4.31 | 0.12 | 36 | 0.003 | | 0.21 | | 1.10 | | | | | |
| Comparative steel 3 | 0.041 | 0.41 | 0.88 | 24.6 | 14.3 | 3.08 | 0.69 | 4 | | | | | | | | | | |
| Comparative steel 4 | 0.058 | 0.79 | 0.31 | 21.5 | 15.6 | 4.89 | 0.45 | 11 | | 0.41 | | 0.12 | | | | 0.021 | | |

TABLE 2

| | Tensile test (R.T) | | | Tensile test (700° C.) | | | Creep rupture time (700° C.) | |
|---|---|---|---|---|---|---|---|---|
| Steel No. | 0.2% proof stress (MPa) | Tensile strength (MPa) | Elongation (%) | 0.2% proof stress (MPa) | Tensile strength (MPa) | Elongation (%) | Applied stress 392 MPa (h) | Applied stress 490 MPa (h) |
| Inventive steel 1 | 902 | 1278 | 38 | 631 | 912 | 25 | 613 | 105 |
| Inventive steel 2 | 912 | 1298 | 31 | 821 | 902 | 27 | 621 | 115 |
| Inventive steel 3 | 921 | 1308 | 32 | 802 | 883 | 21 | 703 | 121 |
| Inventive steel 4 | 915 | 1284 | 28 | 832 | 921 | 24 | 599 | 108 |
| Inventive steel 5 | 912 | 1321 | 31 | 811 | 902 | 21 | 503 | 149 |
| Inventive steel 6 | 952 | 1354 | 28 | 801 | 912 | 27 | 612 | 120 |
| Inventive steel 7 | 931 | 1328 | 32 | 822 | 926 | 29 | 670 | 101 |
| Inventive steel 8 | 912 | 1341 | 29 | 831 | 932 | 21 | 571 | 142 |
| Inventive steel 9 | 906 | 1342 | 31 | 800 | 902 | 22 | 507 | 121 |
| Inventive steel 10 | 915 | 1351 | 24 | 821 | 912 | 25 | 701 | 137 |
| Inventive steel 11 | 901 | 1302 | 29 | 827 | 921 | 22 | 725 | 121 |
| Inventive steel 12 | 918 | 1328 | 31 | 809 | 915 | 26 | 703 | 128 |
| Inventive steel 13 | 932 | 1362 | 25 | 812 | 921 | 21 | 518 | 136 |
| Inventive steel 14 | 927 | 1342 | 33 | 822 | 931 | 24 | 620 | 128 |
| Inventive steel 15 | 921 | 1326 | 28 | 802 | 9a9 | 26 | 591 | 101 |
| Comparative steel 1 | 663 | 1040 | 26 | 549 | 642 | 12 | 16 | 0.4 |
| Comparative steel 2 | 984 | 1130 | 21 | 791 | 902 | 23 | 274 | 104 |
| Comparative steel 3 | 821 | 912 | 27 | 751 | 831 | 26 | 514 | 41 |
| Comparative steel 4 | 951 | 1114 | 26 | 801 | 870 | 22 | 205 | 113 |

As show in Table 2, it is confirmed that the inventive steels No.1~15 are excellent in the 0.2% proof stress and the tensile strength at the room temperature and 700° C. as compared with the steel SUH660, and equal in the elongation to that of the steel SUH660. Furthermore, the creep rupture time of the inventive steels shows value higher than 100 times that of the steel SUH660, respectively.

In the comparative steels No.2 and No.4, the creep rupture time under the applied stress of 392 MPa is short as compared with the inventive steels and the creep lifetime is not so long because the ratio of Ti/Al is too high in the comparative steel No.2 and the Ti content is large excessively in the comparative steel No.4. The comparative steel No.3 is low in the 0.2% proof stress and the tensile strength at the room temperature and 700° C. as compared with the inventive steels because the ratio of Ti/Al is too low.

As described above, in the heat resisting steel according to this invention, it is possible to increase the tensile strength by increasing the Ti content and to improve the strength after the aging treatment in a short time and the creep rupture lifetime at the temperature higher than 700° C. by defining the ratio of Ti/Al. Accordingly, the heat resisting steel of this invention is suitable as a material for components such as a heat-resisting bolt, a valve, a blade and so on of, for example, the engine, the turbine, the heat exchanger, the heating furnace and the nuclear equipment applied in the high-temperature environment higher than conventional temperature. An industrially valuable and very excellent effect can be obtained in that it is possible to reduce the increase in cost to the minimum, because percentages of expensive Ni and Cr is not increased as compared with the conventional heat resisting steels.

What is claimed is:

1. A heat resisting steel consisting by weight percentage of 0.005 to 0.20% of C, 0.01 to 2.0% of Si, 0.1 to 2.0% of Mn, 20 to 30% of Ni, 10 to 20% of Cr, 3.52 to 4.5% of Ti and 0.1 to 0.7% of Al with the ratio Ti/Al being 7 to 20, and the balance being Fe with inevitable impurities.

2. A heat resisting steel consisting by weight percentage of 0.005 to 0.20% of C, 0.01 to 2.0% of Si, 0.1 to 2.0% of Mn, 20 to 30% of Ni, 10 to 20% of Cr, 3.52 to 4.5% of Ti and 0.1 to 0.7% of Al with the ratio Ti/Al being 7 to 20, at least one of 0.001 to 0.050% of B, 0.1 to 3.0% of Nb, 0.001 to 0.50% of Zr and 0.01 to 1.0% of V, and the balance being Fe with inevitable impurities.

3. A heat resisting steel consisting by weight percentage of 0.005 to 0.20% of C, 0.01 to 2.0% of Si, 0.1 to 2.0% of Mn, 20 to 30% of Ni, 10 to 20% of Cr, 3.52 to 4.5% of Ti and 0.1 to 0.7% of Al with the ratio Ti/Al being 7 to 20, at least one of 0.001 to 0.05% of Mg, 0.001 to 0.05% of Ca and 0.001 to 0.05% of REM (rare earth metal), and the balance being Fe with inevitable impurities.

4. A heat resisting steel consisting by weight percentage of 0.005 to 0.20% of C, 0.01 to 2.0% of Si, to 0.1 to 2.0% of Mn, 20 to 30% of Ni, 10 to 20% of Cr, 3.52 to 4.5% of Ti and 0.1 to 0.7% of Al with the ratio Ti/Al being 7 to 20, at least one of 0.001 to 0.050% of B, 0.1 to 3.0% of Nb, 0.001 to 0.50% of Zr and 0.01 to 1.0% of V, at least one of 0.001 to 0.05% of Mg, 0.001 to 0.05% of Ca and 0.001 to 0.05% of REM (rare earth metal), and the balance being Fe with inevitable impurities.

5. A heat resisting bolt made of steel consisting by weight percentage of 0.005 to 0.20% of C, 0.01 to 2.0% of Si, 0.1 to 2.0% of Mn, 20 to 30% of Ni, 10 to 20% of Cr, 3.52 to 4.5% of Ti and 0.1 to 0.7% of Al with the ratio Ti/Al being 7 to 20, and the balance being Fe with inevitable impurities.

6. A heat resisting bolt made of steel consisting by weight percentage of 0.005 to 0.20% of C, 0.01 to 2.0% of Si, 0.1 to 2.0% of Mn, 20 to 30% of Ni, 10 to 20% of Cr, 3.52 to 4.5% of Ti and 0.1 to 0.7% of Al with the ratio Ti/Al being 7 to 20, at least one of 0.001 to 0.050% of B, 0.1 to 3.0% of Nb, 0.001 to 0.50% of Zr and 0.01 to 1.0% of V, and the balance being Fe with inevitable impurities.

7. A heat resisting bolt made of steel consisting by weight percentage of 0.005 to 0.20% of C, 0.01 to 2.0% of Si, 0.1 to 2.0% of Mn, 20 to 30% of Ni, 10 to 20% of Cr, 3.52 to 4.5% of Ti and 0.1 to 0.7% of Al with the ratio Ti/Al being 7 to 20, at least one of 0.001 to 0.050% of Mg, 0.001 to 0.05% of Ca, 0.001 to 0.05% of REM (rare earth metal), and the balance being Fe with inevitable impurities.

8. A heat resisting bolt made of steel consisting by weight percentage of 0.005 to 0.20% of C, 0.01 to 2.0% of Si, 0.1 to 2.0% of Mn, 20 to 30% of Ni, 10 to 20% of Cr, 3.52 to 4.5% of Ti and 0.1 to 0.7% of Al with the ratio Ti/Al being 7 to 20, at least one of 0.001 to 0.050% of B, 0.001 to 3.0% of Nb, 0.001 to 0.50% of Zr and 0.001 to 0.05% of Ca and 0.001 to 0.05% of REM (rare earth metal), and the balance being Fe with inevitable impurities.

* * * * *